US008833761B2

(12) United States Patent
Dukart et al.

(10) Patent No.: US 8,833,761 B2
(45) Date of Patent: Sep. 16, 2014

(54) METHOD FOR MONITORING THE TRANSPORT OF BANK NOTES

(75) Inventors: Eduard Dukart, Munich (DE); Gerhard Sporer, Pöcking (DE); Rudolf Christl, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 13/822,199

(22) PCT Filed: Sep. 19, 2011

(86) PCT No.: PCT/EP2011/004672

§ 371 (c)(1), (2), (4) Date: May 20, 2013

(87) PCT Pub. No.: WO2012/038053

PCT Pub. Date: Mar. 29, 2012

(65) Prior Publication Data

US 2013/0249165 A1 Sep. 26, 2013

(30) Foreign Application Priority Data

Sep. 21, 2010 (DE) ..... 10 2010 046 115

(51) Int. Cl.
*B65H 7/02* (2006.01)
*B65H 7/06* (2006.01)
*G07D 11/00* (2006.01)

(52) U.S. Cl.
CPC ..... *B65H 7/06* (2013.01); *G07D 11/0039* (2013.01)
USPC ..... 271/258.01; 271/265.01; 271/176; 209/534

(58) Field of Classification Search
USPC ..... 271/258.01, 259, 265.01, 265.02, 298, 271/176; 209/534
See application file for complete search history.

(56) References Cited

U.S. PATENT DOCUMENTS 4,236,639 A 12/1980 Boettge et al.
4,324,394 A 4/1982 Mitzel et al.

(Continued)

FOREIGN PATENT DOCUMENTS

DE 27 60 453 C2 1/1979
DE 100 50 486 A1 4/2002

(Continued)

OTHER PUBLICATIONS

International Search Report for PCT/EP2011/004672, Dec. 7, 2011.

(Continued)

*Primary Examiner* — David H Bollinger
(74) *Attorney, Agent, or Firm* — Workman Nydegger

(57) ABSTRACT

A method for monitoring transport of bank notes in a transport system, using sensors arranged along the transport system for sensing transported bank notes, and a control device for monitoring and controlling the transport system using signals from the sensors, from which the control device derives a presence or absence of a bank note at the location of the respective sensor. The signals from all sensors are stored in a memory, and the signals from all sensors are assigned an explicit time statement or clock statement. All transported bank notes are assigned an explicit object code by the control device, and the object code is linked to the explicit time statement or clock statement. Stored signals from the sensors derive the occurrence and type of errors during the transport of the bank notes, and the signals are linked to the bank notes denoted by the object codes.

10 Claims, 4 Drawing Sheets

(56) References Cited

U.S. PATENT DOCUMENTS

| | | | |
|---|---|---|---|
| 4,339,221 | A | 7/1982 | Mitzel et al. |
| 4,346,851 | A | 8/1982 | Bernardi et al. |
| 2004/0039479 | A1 | 2/2004 | Dietrich et al. |
| 2008/0224387 | A1 | 9/2008 | Tamagaki |
| 2009/0001157 | A1 | 1/2009 | Buntscheck et al. |
| 2010/0052237 | A1 | 3/2010 | Herczeg et al. |

FOREIGN PATENT DOCUMENTS

| | | | |
|---|---|---|---|
| DE | 10 2004 049 209 | A1 | 4/2006 |
| EP | 1 632 909 | A1 | 3/2006 |
| GB | 2 131 402 | A | 6/1984 |

OTHER PUBLICATIONS

German Search Report for DE 10 2010 046 115.6, Jun. 7, 2011.

METHOD FOR MONITORING THE TRANSPORT OF BANK NOTES

BACKGROUND OF THE INVENTION

A. Field of the Invention

The invention relates to a method for monitoring the transport of bank notes.

B. Related Art

For the processing of bank notes it is provided that the bank notes are input to an input region as loose stacks and singled by a singler. The single bank notes are transferred by the singler to a transport system and supplied to processing. Conventional forms of processing for bank notes are acceptance, checking and recognition of the bank notes by means of sensors, whereby authenticity, type (currency, denomination), condition (soiling, damage), etc, are determined. Based on the results of checking and recognition, the bank notes are thereafter e.g. sorted, stacked, bundled, destroyed, etc.

For the processing of bank notes in bank note processing machines it is of fundamental importance that the transport of the bank notes is effected without error by the transport system, i.e. for example no jammings or delays may occur.

For monitoring the proper transport of the bank notes it is known to provide light barriers at one or several positions in the transport system, which capture the transport of the bank notes. The light barriers detect the presence or absence of a bank note at the respective position of the light barrier. In particular, leading edge and trailing edge of the transported bank notes are recognized.

If problems occur upon transport, it cannot be readily recognized, whereby these problems are caused.

Starting out from the mentioned defects, the invention is based on the object to state a method for monitoring the transport of bank notes, which makes possible an analysis of occurred transport errors.

The invention starts out from a method for monitoring the transport of bank notes in a transport system, having sensors arranged along the transport system for capturing transported bank notes and a control device for monitoring and controlling the transport system on the basis of signals of the sensors, from which the control device derives a presence or absence of a bank note at the place of the respective sensor, in which method the signals of all the sensors are stored in a memory by the control device, wherein the signals of all the sensors are assigned a unique time specification or cycle specification, and all the transported bank notes are assigned by the control device a unique object code, which is linked with the unique time specification or cycle specification, and that the occurrence and type of errors upon transport of the bank notes are derived through evaluation of the stored signals of the sensors, for which purpose the signals of the sensors, that are provided with the unique time specifications or cycle specifications, are associated with the bank notes denoted via the unique object codes.

The advantage of the solution according to the invention is that through the evaluation of the stored signals of the sensors there is made possible an analysis of transport errors which allows determining or at least narrowing down the place in the transport system where the transport error has occurred. From the stored signals of the sensors there can be additionally derived statements about the type of an error that has occurred.

In an advantageous development it is provided, in addition, to normalize all the signals of the sensors that are associated with a unique object code to one of the sensors, in particular the first sensor in the transport system, for which purpose the unique time specifications or cycle specifications for each sensor to be normalized are shifted by a run-time difference or a cycle number, wherein the run-time difference or the cycle number result from the distance of the sensor to be respectively normalized from the sensor serving as a normalization basis, a transport speed employed in the transport system, as well as the location of the sensor to be respectively normalized in relation to the sensor in the transport system that serves as a normalization basis.

This makes possible a particularly simple evaluation and analysis of transport errors, since all the signals of the sensors that are present for a transported bank note seem to be present at one single point in time, which is why deviations in the transport of the bank note are particularly easy to determine.

In other advantageous developments it is provided to derive additional information items denoting the type and/or quality of the bank notes from signals of a sensor device and to store them so as to be linked with the object code of the respective bank note. Likewise, additional information items of the control device denoting the transport of the bank notes can be linked and stored with the object code of the respective bank note.

The additional information items denoting the type and/or quality or the transport of the bank notes make it possible that upon evaluation of the stored signals of the sensors a selection can be made as to which sensors must be taken into account for the respective bank note. This makes it possible to limit the number of the sensors or their signals that are to be taken into account for evaluating.

DESCRIPTION OF THE DRAWINGS

Further embodiments and advantages of the invention are explained in the following with reference to Figures and their description.

There are shown

In FIG. 1 there is represented a basic structure of a bank note processing machine 100 for processing bank notes.

DETAILED DESCRIPTION OF EXEMPLARY EMBODIMENTS OF THE INVENTION

Figure 1:
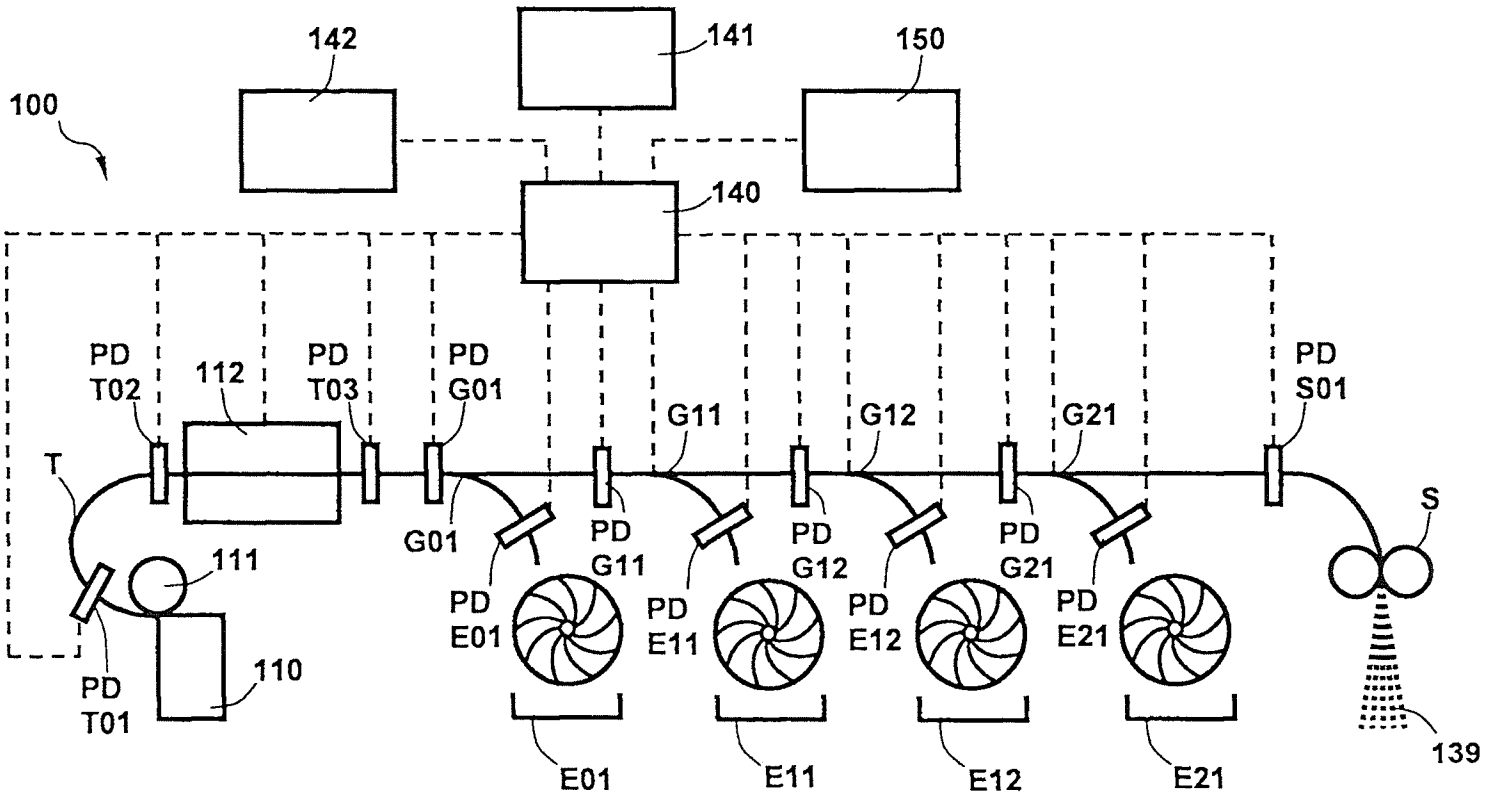
FIG. 1 an embodiment of a basic structure of a bank note processing machine, FIGS. 2 to 5 signals of light barriers of the bank note processing machine of FIG. 1.

The bank note processing machine 100 has an input unit 110 into which bank notes are inserted. To the input unit 110 there is connected a singler 111 which withdraws single bank notes from the input unit 110 and transfers them to a transport system T. The transport system T transports the single bank notes through a sensor device 112 which ascertains data from the bank notes, which make possible for example conclusions about quality (authenticity, condition, etc) and type (currency, denomination, etc). The ascertained data of the bank notes are transferred to a control device 140 which evaluates the data and thus controls the further flow of the bank notes through the bank note processing machine 100. For this purpose, the control device 140 acts on gates G01 to G21 which are components of the transport system T and allow the bank notes to be deposited in output units E01 to E21 according to predetermined criteria. The output units E01 to E21 can be configured for example as spiral slot stackers, which stack the bank notes to be deposited in deposit units by means of rotating units having spiral slots. In addition, a shredder S can be present, e.g. in order to destroy 139 bank notes no longer fit for circulation. The bank note processing machine 100 can be controlled by an operator by means of an input/output device 150, e.g. a touch screen, connected with the control device 140.

Bank notes recognized by sensor device 112 and control device 140 are deposited in the output units E01 to E21 corresponding to predetermined criteria in dependence on the result of the check. For example, bank notes in good condition (bank notes fit for circulation) can be deposited in the output E11. For this purpose, the gate G11 is actuated by control device 140. Bank notes in poor condition (bank notes no longer fit for circulation) are deposited in the output E12. For this purpose, the gate G12 is actuated by control device 140. Selectively, bank notes in poor condition can also be destroyed by means of shredder S. In this case, none of the gates G01 to G21 is actuated by control device 140. Bank notes which, upon checking, cannot be recognized by the sensor device 112 and the control device 140 are deposited for example in output E01. For this purpose, the gate G01 is actuated by control device 140.

Information items about number, type and, where applicable, quality of the recognized bank notes are captured and stored by control device 140. The recognized bank notes can be brought to account by an assignment of the number of recognized bank notes and their type, or through a total value resulting therefrom, and for example credited to a certain account or depositor.

During the transport of the bank notes through the transport system T there is effected a monitoring of the respectively transported bank notes by means of sensors PDT01 to PDS01 arranged in the transport system T. The sensors PDT01 to PDS01 can be formed for example by light barriers, which for example generate a logical one while no bank note is present, as in this case a detector of the light barrier receives light emitted from a light source, whereas the light barriers generate a logical zero as soon as a bank note is present, as in this case the light source is covered by the bank note, which is why the detector receives light that is at best very weakened. Instead of the above-described transmission light barriers, there can also be employed reflection light barriers or mechanical sensors, ultrasonic sensors, etc, which can detect the presence or absence of the bank notes.

A first light barrier PDT01 is arranged in the transport system T after the singler 111 and captures, for example, whether the singler 111 transfers bank notes at certain points in time to the transport system T. A second light barrier PDT02 is arranged before, and a third light barrier PDT03 after, the sensor device 112. A fourth light barrier PDG01 is located before, and a fifth light barrier PDE01 after, the first gate G01. A sixth light barrier PDG11 is located before, and a seventh light barrier PDE11 after, the second gate G11. An eighth light barrier PDG12 is located before, and a ninth light barrier PDE12 after, the third gate G12. A tenth light barrier PDG21 is located before, and an eleventh light barrier PDE21 after, the fourth gate G21. A twelfth light barrier PDS01 is located before the shredder S.

After the singling of a bank note through the singler 111, the bank note is transported by the transport system T and captured by the first light barrier PDT01. The signal of the first light barrier PDT01 is evaluated by the control device 140. On the basis of the signal change of the first light barrier PDT01 upon arrival of the leading edge of the bank note, the presence of the bank note is recognized by the control device 140. The control device 140 allocates to the bank note a unique identification for the further processing and tracking in the transport system T, e.g. a numeral incremented by one with each bank note, which in the following is referred to as the object code. For example, the two-hundred-ninth bank note singled by singler 111 is assigned the object code 209. The bank note having the object code 209 is transported further by the transport system T and then reaches the second light barrier PDT02 before the sensor device 112. Since the length of the path between first light barrier PDT01 and second light barrier PDT02 and also the transport speed of the transport system T are known, a point in time can be ascertained by the control device 140, at which the bank note having the object code 209 reaches, upon error-free operation, the second light barrier PDT02.

Instead of monitoring certain points in time, also a cycle can be defined for the transport system T, which depends on the transport speed of the transport system T. For example, the cycle can be defined such that the time duration of a cycle corresponds to the transport of a bank note located in the transport system T by 1 mm. If, for example, 40 bank notes are transported per second, per bank note 25 cm being provided (for the bank note and a gap to the next bank note), there results a transport speed of 10 m/s for the transport system T. In this case the time duration of a cycle is 100 μs. If the distance between first light barrier PDT01 and second light barrier PDT02 is for example 300 mm, it takes a bank note coming from the first light barrier PDT01 300 cycles or 30 ms to reach the second light barrier PDT02. If the distance between second light barrier PDT02 and third light barrier PDT03 is for example 700 mm, it takes 70 ms or 700 cycles from the second light barrier PDT02 to reach the third light barrier PDT03. The cycle can be obtained for example by the control device 140 from signals of a drive control of the transport system T. Upon generation, each of the cycles can be uniquely numbered.

Since the distances of all light barriers PDT01 to PDS01 to each other are known, the control device 140 can determine the time duration or number of cycles, that are required for the transport of a bank note from a light barrier to any other light barrier. This makes it possible for the transport of all bank notes in the transport system T to be monitored by the control device 140. If for example the leading edge of the above-mentioned bank note having the object code 209 is captured at a certain point in time by the first light barrier PDT01, the third light barrier PDT03 must also capture a leading edge 100 ms later. The same applies, if the above-mentioned cycle is employed. In this case, for example the leading edge of the bank note having the object code 209 is captured at a certain cycle by the first light barrier PDT01, so that the third light barrier PDT03 must also capture a leading edge 1000 cycles later.

For monitoring the transport system T, the control device 140 evaluates the signals of the light barriers PDT01 to PDS01 and in case of deviations from expected presences or absences of bank notes can generate warning signals or initiate measures for trouble-shooting or for preventing damage of the bank note processing machine 100, e.g. stopping the transport system T. It can be provided that certain differences are tolerated upon the evaluation of the recognized deviations through the control device 140. For example, if the presence or absence of an expected bank note at a certain light barrier is determined some cycles too early or too late.

After the occurrence of errors upon the transport of the bank notes in the transport system T, an analysis of the errors is to be made possible. For this purpose, information items about the transport of the bank notes are recorded by the control device 140 in a memory 141 of the control device 140. The memory can be a non-volatile memory, e.g. a solid-state memory or a hard drive. The information items required for the analysis can be retained in the memory for example for a time period, e.g. one or several hours, a day or a week. After expiration of the predetermined time period the information items are overwritten with new information items.

The information items stored for the analysis of occurred transport errors include in particular the signals of the light barriers PDT01 to PDS01. The signals of the light barriers PDT01 to PDS01 are stored for each cycle, i.e. each of the cycles are uniquely assigned the respective information of each light barrier PDT01 to PDS01, as to whether a bank note is present and/or absent, e.g. via the mentioned numbering of the cycles, and said information is stored in the memory 141. In addition, information items about the processed bank notes are stored. For this purpose, the object code of the bank notes is employed. The object code is assigned for example the information in which cycle the recognition has been effected by the first light barrier PDT01. For this purpose, the corresponding cycle number is stored together with the object code. Furthermore, the object code of the bank notes can be assigned the result of the assessment through the sensor device 112 and stored. For this purpose, the object code of each bank note is assigned for example whether it could have been recognized and, if so, the recognized type of the bank note, i.e. for example to which currency and denomination it belongs. Moreover, information items about authenticity, condition, etc can be stored together with the object code. In addition to or instead of these information items further information items about the transport of the respective bank note can be stored together with the object code. If, for example, a bank note has not been recognized by the sensor device 112 and the control device 140 upon checking, there can be stored the information that for the bank note having the corresponding object code a depositing in the output unit E01 is provided, for which purpose the gate G01 has to be switched. If, in another example, a bank note has been recognized upon checking, which is no longer suitable for further circulation, there can be stored the information that the destruction of the bank note having the corresponding object code through the shredder S is provided, for which purpose none of the gates G01 to G21 has to be switched.

Upon the analysis of occurred transport errors, the stored information items about the transport flow, i.e. the signals of the light barriers for the bank notes or their object codes, are evaluated by the control device 140. For this purpose, there is effected a normalization or a cycle normalization for the respective bank note or its object code. In this context, normalization is understood to mean, that all the information items available for a bank note or its object code are edited and, where applicable, represented on the input/output device 150 as if they had occurred at a single point in time.

In the above-mentioned example, in which a bank note could not have been recognized by the sensor device 112 and the control device 140 upon the check, the stored information of the transport flow is edited as if it had occurred at one single point in time or cycle. For this purpose, the signals of all the light barriers PDT01 to PDS01 are normalized to a single point in time or cycle. This is achieved by e.g. the stored signals of the first light barrier PDT01 being employed in unchanged fashion, whereas the signals of the subsequent light barriers PDT02 to PDS01 are temporally shifted corresponding to their distance and the transport speed such that they correspond to the point in time of the signal of the first light barrier PDT01. Accordingly, the signals of the light barriers can also be normalized, if necessary, to a different light barrier. For the example described with reference to FIG. 1 this means that the signals of the second light barrier PDT02 are shifted forward by 300 cycles or 30 ms and the signals of the third light barrier PDT03 forward by 1000 cycles or 100 ms. The signals for a bank note transported without errors are then congruent for the first to third light barriers PDT01 to PDT03 or exhibit only minor deviations. The signals of the fourth to twelfth light barriers PDG01 to PDS01 are shifted accordingly, in order to achieve the desired normalization to the signals of the first light barrier PD01. If the normalization is effected to a light barrier different from the first light barrier PDT01, also the arrangement of the light barriers in the transport system T must be taken into account. Signals of light barriers that are located, regarded in transport direction, after the light barrier serving as a normalization basis, must be shifted forward with regard to time or cycle, as described above. Signals of light barriers that are located, regarded in transport direction, before the light barrier serving as a normalization basis, must be shifted backward with regard to time or cycle.

Upon analysing, the further information items can be taken into account. In the previously mentioned example, in which a bank note could not have been recognized by the sensor device 112 and the control device 140 upon the check, for example the editing of the stored signals of the first to fifth light barriers PDT01 to PDE01 plus the sixth light barrier PDG11 is sufficient, since for such bank notes the depositing in the first output E01 is provided. Upon error-free transport, there result matching signals of the first to fifth light barriers PDT01, PDT02, PDT03, PDG01 and PDE01. If for example an error has occurred at the first gate G01, so that the bank note was not output to the first output unit El, but was transported further, there result matching signals of the first to fourth light barriers PDT01, PDT02, PDT03, PDG01 as well as a matching, non-expected signal for the sixth light barrier PDG11, whereas no signal is present for the fifth light barrier PDE01. Through this evaluation, the occurred transport error can be localized to be at the first gate G01.

For illustrating the described procedure, further examples of analysing errors occurred during the monitoring of the transport of bank notes are represented in FIGS. 2 to 5, which show signals of the light barriers of the bank note processing machine 100, a presence of bank notes being represented with a high signal, the absence of bank notes with a low signal.

Figure 2:
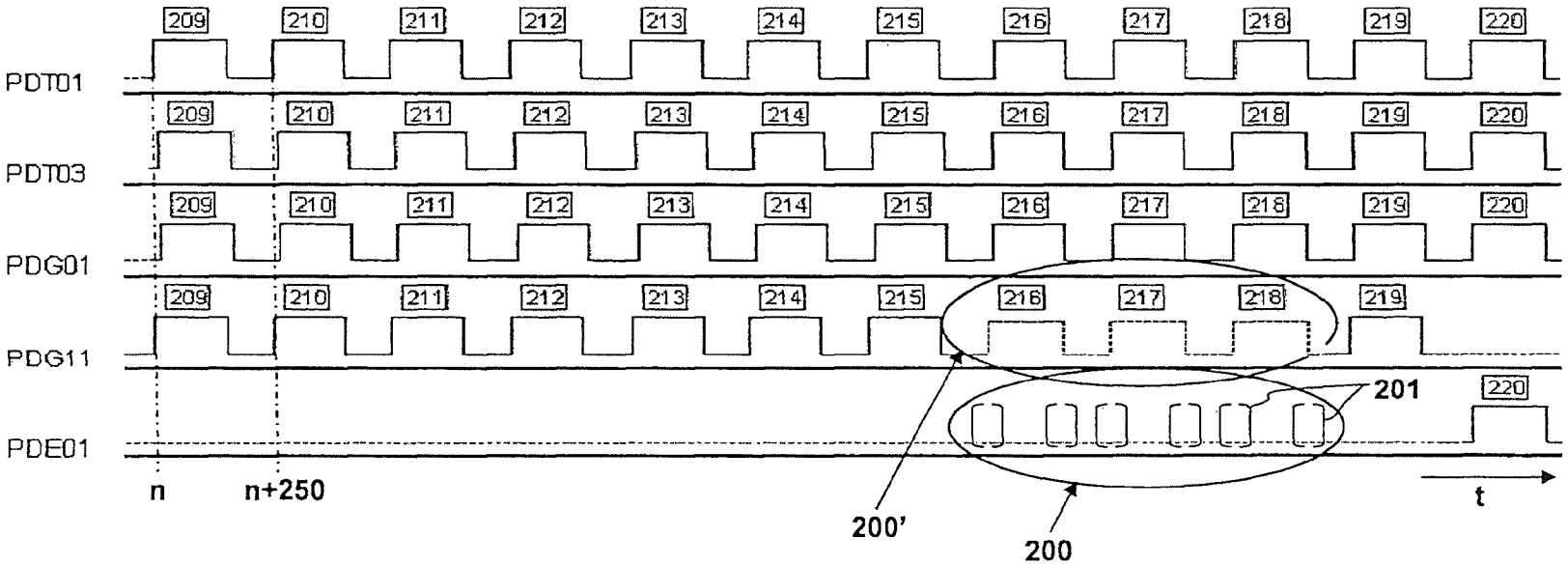

In FIG. 2 there is shown a faulty transport of bank notes having the object codes 216, 217 and 218. The signals of the first and third to sixth light barriers PDT01, PDT03, PDG01, PDE01 and PDG11 are represented.

The signals of all the represented light barriers are normalized, as described above, to the signal of the first light barrier PDT01, e.g. through the shift by a number of cycles, which number corresponds to the distance between the light barriers. Thus, all the events relating to a bank note or an object code seem to take place at one point in time or cycle. In the represented example, the bank note denoted with the object code 209 begins with the cycle n and ends with the cycle n+250, corresponding to the above-described example, according to which a cycle corresponds to one millimeter and for each bank note 25 cm transport path are available. Subsequent bank notes having higher object codes 210 to 220 follow, corresponding to the progress of the cycle t, on the right-hand side of the object code 209 depicted first.

The bank notes having the object codes 216, 217 and 218 were not recognized by sensor device 112 and control device 140 in the represented example, which is why they are to be deposited in the first output unit E01. Upon analysing the signals of the fifth and sixth light barriers PDE01 and PDG11 it is recognized, however, that the bank notes having the object codes 216, 217 and 218 have generated no signals at the fifth light barrier PDE01 at the expected cycle or at the expected time. Instead, at the expected cycle there were generated signals 200' by the sixth light barrier PDG11, which correspond to the bank notes having the object codes 216, 217 and 218. Thus, from the analysis of the signals of the light barriers there can be derived a transport error that has occurred at the place of the first gate G01. As shown in FIG. 2 for the fifth light barrier PDE01, there can be displayed points in time 201 at which signals are expected, e.g. with a representation of the signals by means of the input/output device 150. As represented, for the points in time 201 of the expected signals there can be displayed tolerance ranges.

Figure 3:
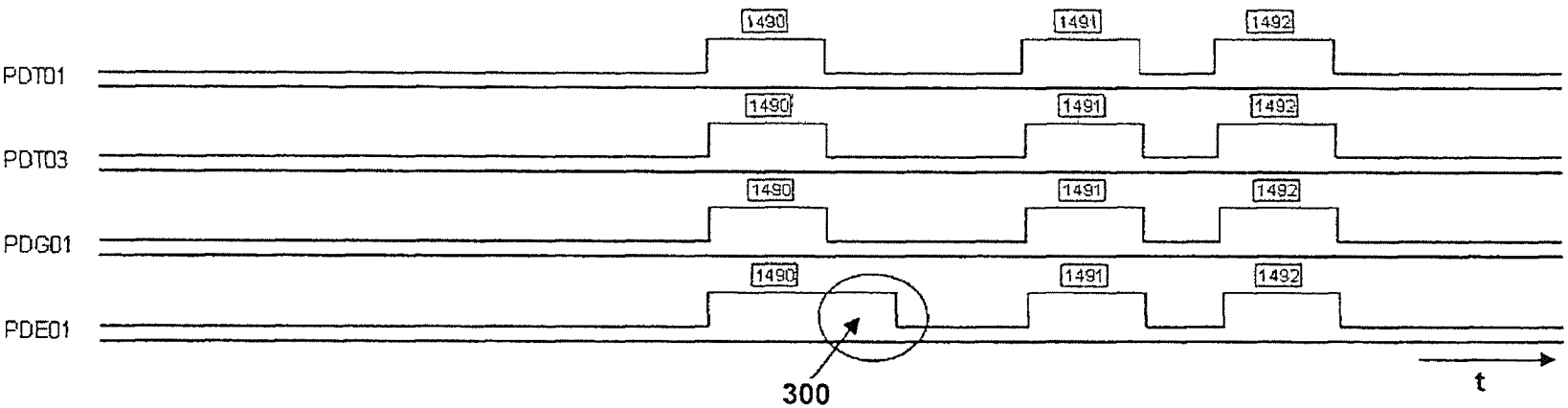

In FIG. 3 there is shown the faulty transport of a bank note having an object code 1490. The signals of the first and third to fifth light barriers PDT01, PDT03, PDG01 and PDE01 are represented.

The signal 300 of the bank note having the object code 1490 at the fifth light barrier PDE01 is much longer than the signals of this bank note having the object code 1490 at the other light barriers PDT01, PDT03 and PDG01. At the time of the transport of the bank note having the object code 1490 there was therefore present a mechanical resistance in the region of the fifth light barrier PDE01, which has slowed down the transport of the bank note having the object code 1490 at this place.

Figure 4:
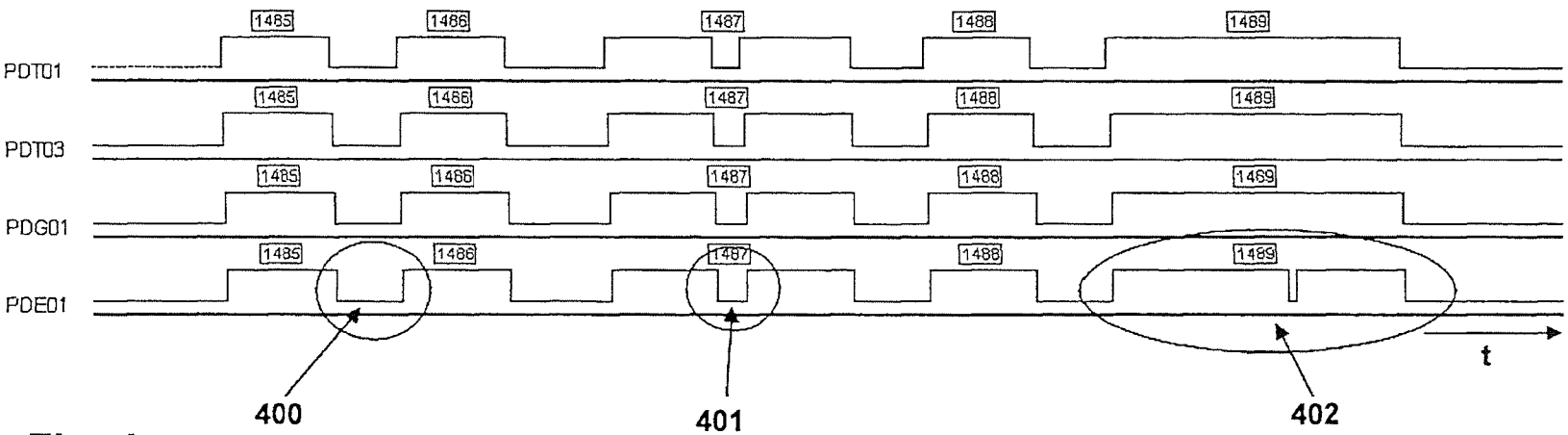

In FIG. 4 there are shown faulty singlings and the subsequent transport of bank notes having object codes 1487 to 1489. The signals of the first and third to fifth light barriers PDT01, PDT03, PDG01 and PDE01 are represented.

For comparison, signals of the light barriers PDT01, PDT03, PDG01 and PDE01 for bank notes having object codes 1485 and 1486 are represented. These bank notes were singled without error by singler 111 and transferred to the transport system T. The length of the bank notes and a gap 400 provided between them corresponds to an error-free singling and an error-free transport.

Subsequent to the bank note having the object code 1486 there were captured two bank notes such that the gap 401 occurring between them is too small, which is why the bank notes cannot be separated from each other and therefore the two bank notes are assigned only one object code 1487.

Finally, in the signals of the light barriers PDT01, PDT03, PDG01 and PDE01 there is represented a supposedly very large bank note 402 having an object code 1489, which is larger than the largest permissible bank note, however. Upon analysing, this signal of the supposedly very large bank note 402 may be interpreted as an imbricated multiple removal. This means, that two or several overlapping bank notes were transferred from the singler 111 to the transport system T. This interpretation of the signals of the light barriers PDT01, PDT03, PDG01 and PDE01 through the control device 140 can be confirmed by a comparison of the signals of the light barriers PDT01, PDT03, PDG01 and PDE01 among each other. While the signals of the light barriers PDT01, PDT03 and PDG01 seem to indicate the uninterrupted presence of a bank note for the object code 1489, in the signal of the light barrier PDE01 there can be recognized a short interruption and thus the presence of more than one bank note. The gap between the multiply captured bank notes, which is recognizable in the signal of the light barrier PDE01, may arise during the transport of the imbricated bank notes through the transport system T, e.g. through a slippage between the imbricated bank which occurs therein, as a result of which the imbrication of the bank notes can be resolved.

Figure 5:
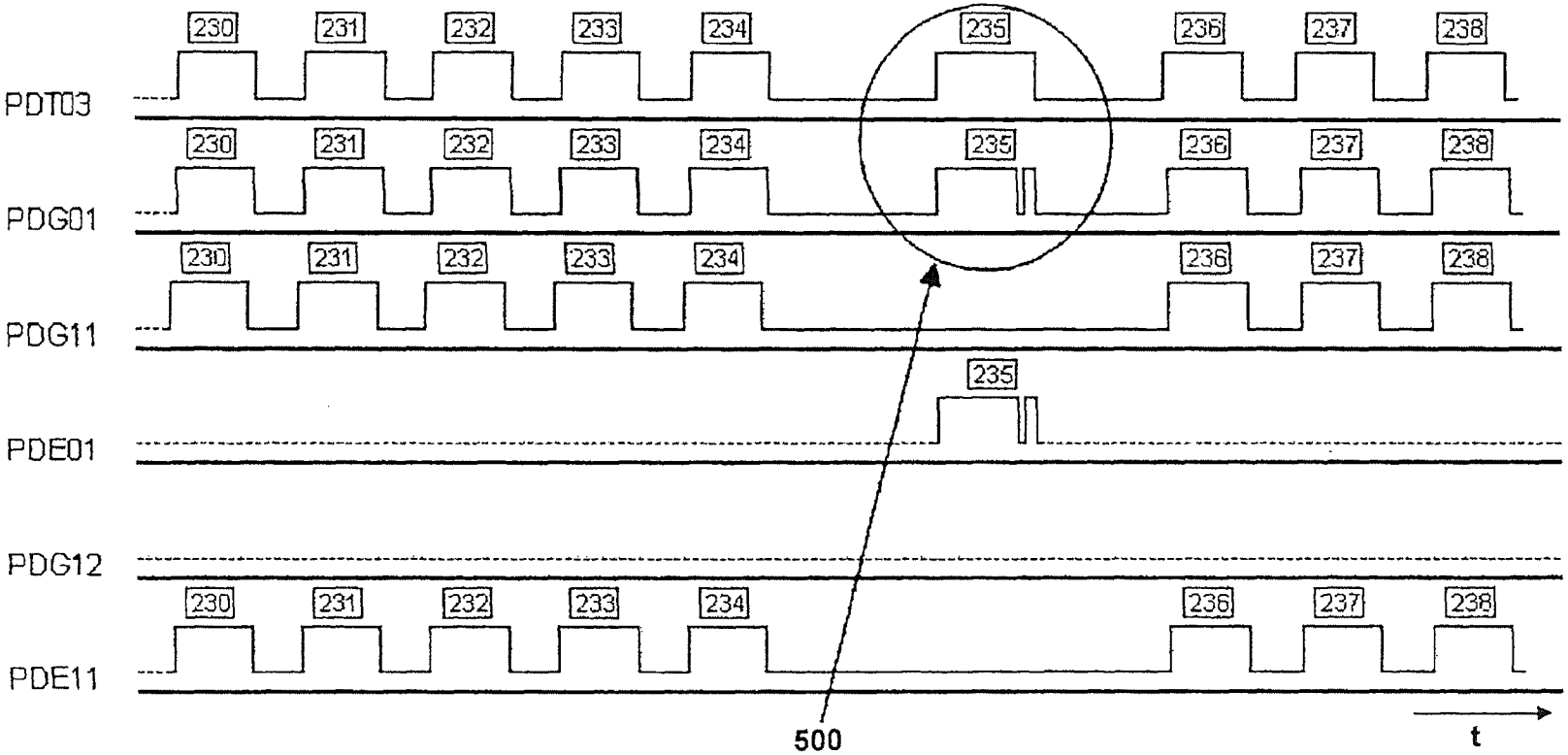

In FIG. 5, there is shown the damaging of a bank note having object code 235 during the transport of the bank note in the transport system T. The signals of the third to eighth light barrier PDT03, PDG01, PDE01, PDG11, PDE11 and PDG12 are represented.

The bank note having the object code 235 is present in undamaged form at the third light barrier PDT03, as it can be inferred from the signal in the region 500 of the third light barrier PDT03, which indicates the presence of the bank note over the entire length of the bank note. The signal in the region 500 of the subsequent light barrier PDG01, however, exhibits an interruption for the bank note having the object code 235, which can be interpreted as a damaging, e.g. as a tear or tear-off, of the bank note having the object code 235. Thus, the bank note having the object code 235 must have been damaged between the third and fourth light barrier PDT03 and PTG01.

If transport errors, e.g. the previously described damaging of a bank note, are recognized by the control device 140, the control device 140 can initiate countermeasures, in order to avoid a malfunction in the operation of the bank note processing machine 100, e.g. jammings, or a damaging of the bank note processing machine 100. For this purpose, it can be provided for example that the control device 140 stops the singler 111 and/or the transport system T. It can also be provided that the bank note for which a transport error has been recognized is transported into a special output, e.g. the first output unit E01, into which all the bank notes are transported which must be manually post-processed by the operator. It is also possible to transport such bank notes into the closest output unit, so that they are removed from the transport system T as fast as possible. In the represented example, the first gate G01 arranged immediately after the fourth light barrier PDG01 is actuated by the control device 140, in order to remove the damaged bank note having the object code 235 from the transport system T and to deposit it in the first output unit E01. In addition, the transport system T and/or the singler 111 can be stopped or the speed be reduced.

In accordance with the initiated measure, the control device 140 stores information in the memory 141 as to how the bank note denoted with the corresponding object code was handled after the recognition of the transport error. This allows a subsequent post-processing by the operator, who can retrieve the corresponding information for example by means of the input/output device 150.

Besides the above-described evaluation and/or representation of the information items of the light barriers by means of the control device 140 and/or the input/output device 150, an analysis of the information items can also be effected at a different place or by different means. For this purpose, there can be present for example an interface 142, e.g. a USB interface, for transferring the information items. The information items can be contained for example in lists or tables. It is also possible to prepare the information items as a script file, e.g. as an XML file.

The ascertained errors, e.g. jammings or malfunctions of a certain region of the transport system T, can be displayed e.g. by means of the input/output device 150. For this purpose, a schematic representation of the bank note processing machine 100 can be represented on the input/output device 150, as it is represented e.g. in FIG. 1. The region of the transport system T in which the error was ascertained, e.g. between the light barriers PDT03 and PDG01, can then be represented in a specially denoted fashion. Furthermore, the ascertained type of error, e.g. jamming, can be displayed.

Besides the bank note processing machine 100 described above with reference to FIG. 1, a number of modifications are possible. Besides the represented central control device 140, there can also be employed several decentralized control devices, which e.g. monitor and control certain sections of the transport system T and thus certain light barriers. There can also be present further light barriers, e.g. within the sensor device 112. It is possible to evaluate signals of individual sensors of the sensor device 112, e.g. the mentioned optical, acoustic, mechanical, etc sensors, in order to derive the presence or absence of bank notes, like from the signals of a light barrier. Besides the described bank note processing machine 100, which is suitable substantially for sorting bank notes, the transport in any other bank note processing machine, which can be suitable e.g. for the paying in and/or paying out of bank notes, can be monitored and analysed in the manner described above.

The invention claimed is:

1. A method for monitoring the transport of bank notes in a transport system, the transport system including sensors arranged along the transport system that capture transported bank notes and a control device that monitors and controls the transport system on the basis of signals of the sensors, the control device deriving a presence or absence of a bank note at the place of the respective sensor, the method comprising:

storing the signals of all the sensors using the control device, wherein the signals of all the sensors are assigned a unique time specification or cycle specification, assigning, by the control device, a unique object code to each of the transported bank notes, linking each assigned object code with the unique time specification or cycle specification, and deriving the occurrence and type of errors upon transport of the bank notes by evaluation of the stored signals of the sensors, wherein the signals of the sensors, that are provided with the unique time specifications or cycle specifications, are associated with the bank notes denoted via the unique object codes.

2. The method according to claim 1, wherein all the signals of the sensors that are associated with a unique object code are normalized to one of the sensors, for which purpose the unique time specifications or cycle specifications for each sensor to be normalized are shifted by a run-time difference or a cycle number, wherein the run-time difference or the cycle number result from the distance of the sensor to be respectively normalized from the sensor serving as a normalization basis, a transport speed employed in the transport system, as well as the location of the sensor to be respectively normalized in relation to the sensor in the transport system that serves as a normalization basis.

3. The method according to claim 1, wherein additional information items denoting the type and/or quality of the bank notes are derived from signals of a sensor device and stored so as to be linked with the object code of the respective bank note.

4. The method according to claim 3, wherein the additional information items denoting the type and/or quality of the bank notes are used for evaluating the stored signals of the sensors, in order to select the sensors or their signals that are to be taken into account upon evaluation.

5. The method according to claim 1, wherein additional information items of the control device that denote the transport of the bank notes are linked and stored with the object code of the respective bank note.

6. The method according to claim 5, wherein the additional information items denoting the transport of the bank notes are used for evaluating the stored signals of the sensors, in order to select the sensors or their signals that are to be taken into account upon evaluation.

7. The method according to claim 1, wherein the signals of the sensors are edited by the control device for a representation.

8. The method according to claim 7, wherein the control device, upon evaluation, classifies the signals of the sensors into expected or non-expected signals and edits expected and non-expected signals differently for the representation.

9. The method according to claim 8, wherein the control device generates tolerance ranges for the expected signals of the sensors and edits them for the representation.

10. The method according to claim 1, used to monitor a transport path of a bank note processing machine.

* * * * *